US008502736B2

(12) United States Patent
Ma et al.

(10) Patent No.: US 8,502,736 B2
(45) Date of Patent: Aug. 6, 2013

(54) ELECTRONIC DEVICE HAVING ANTENNA

(75) Inventors: Chin-Hung Ma, New Taipei (TW); Chi-Sheng Liu, New Taipei (TW); Shu-Hua Hsu, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 211 days.

(21) Appl. No.: 13/219,723

(22) Filed: Aug. 29, 2011

(65) Prior Publication Data

US 2012/0162019 A1 Jun. 28, 2012

(30) Foreign Application Priority Data

Dec. 27, 2010 (TW) ..... 99146048 A

(51) Int. Cl.
*H01Q 1/38* (2006.01)

(52) U.S. Cl.
USPC ..... 343/700 MS; 343/702; 343/846; 343/866; 343/873; 343/872

(58) Field of Classification Search
None
See application file for complete search history.

(56) References Cited

U.S. PATENT DOCUMENTS

| | | | | |
|---|---|---|---|---|
| 6,985,111 | B2 * | 1/2006 | Hara et al. | 343/702 |
| 7,009,563 | B2 * | 3/2006 | Mori et al. | 343/700 MS |
| 7,525,486 | B2 * | 4/2009 | Shtrom et al. | 343/700 MS |
| 2004/0056803 | A1 * | 3/2004 | Soutiaguine et al. | 343/700 MS |
| 2005/0179595 | A1 * | 8/2005 | Yamamoto | 343/700 MS |
| 2011/0068985 | A1 * | 3/2011 | Hillersborg | 343/702 |

* cited by examiner

*Primary Examiner* — Trinh Dinh
(74) *Attorney, Agent, or Firm* — Altis Law Group, Inc.

(57) ABSTRACT

An electronic device includes a multi-layer circuit board, a main antenna, and an electronic element. The multi-layer circuit board includes an outer layer, a ground layer, and a plurality of vias defined therein electrically connected the outer layer and the ground layer. The main antenna is mounted on the outer layer and electrically connected to the ground layer by the vias. The electronic element is mounted on the outer layer, soldered on the main antenna, and electrically connected to the ground layer by the main antenna.

7 Claims, 4 Drawing Sheets

ELECTRONIC DEVICE HAVING ANTENNA

RELATED APPLICATIONS

This application claims priority under 35 U.S.C. 119 from TAWAN application serial No. 099146048 filed Dec. 27, 2010, the contents of which are incorporated herein by references.

BACKGROUND

1. Technical Field

The disclosure generally relates to electronic devices having antennas, and particularly to an electronic device having stable and reliable antenna radiation performance.

2. Description of Related Art

Antennas are important components of portable electronic devices such as mobile phones and personal digital assistants (PDAs) and are used for transmitting and receiving signals. Generally, when the antennas are installed in the portable electronic devices, a necessary mounting space clear of other electronic elements is required. However, because of the volume limitations of the portable electronic devices, it may difficult to meet the requirement.

Therefore, there is room for improvement within the art.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment.

DETAILED DESCRIPTION

Figure 1:
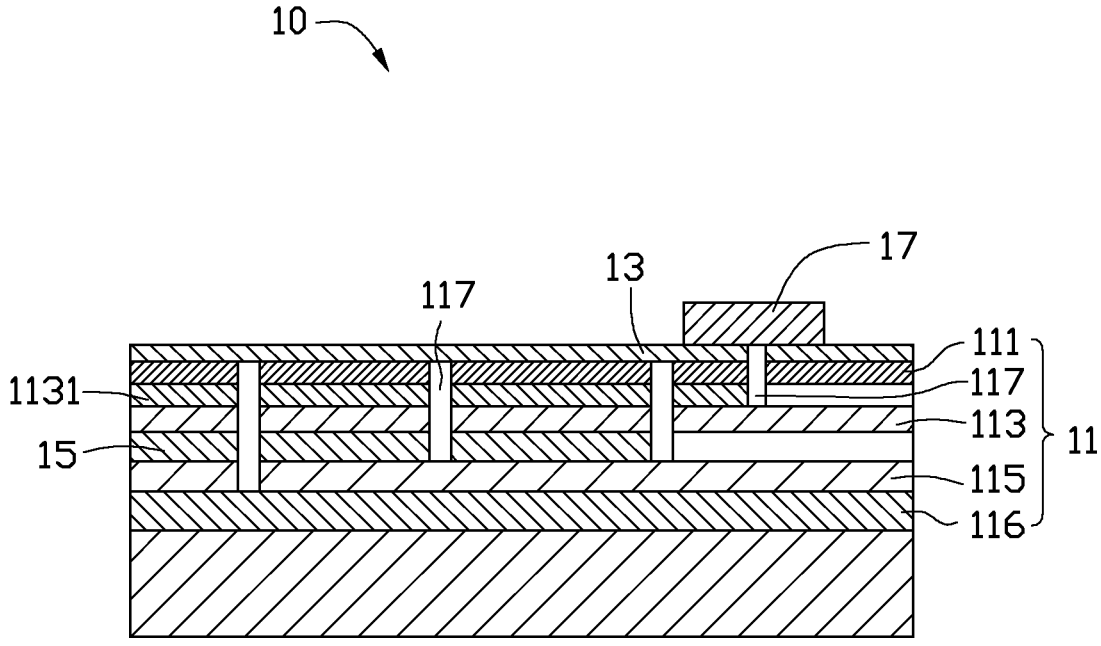
FIG. 1 is a schematic cross-sectional view of an electronic device, according to an exemplary embodiment.

FIG. 1 is a schematic cross-sectional view of an electronic device 10, according to an exemplary embodiment. The electronic device 10 includes a multilayer circuit board 11, a main antenna 13, a minor antenna 15, and an electronic element 17. The main antenna 13, the minor antenna 15 and the electronic element 17 are mounted to the multilayer circuit board 11.

In the illustrated embodiment, the circuit board 11 includes an outer layer 111, a first inner layer 113, a second inner layer 115, and a ground layer 116. A plurality of vias 117 are defined in the circuit board 11 through the outer layer 111, the first inner layer 113, and the second inner layer 115. The outer layer 111, the first inner layer 113, and the second inner layer 115 are electrically connected by the vias 117.

Figure 2:
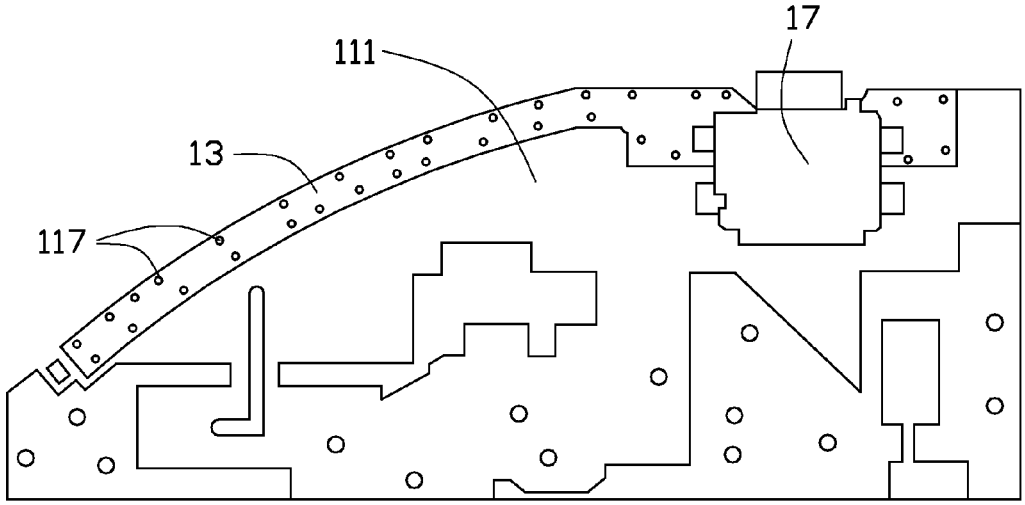
FIG. 2 is a schematic view of one embodiment of an outer layer of the electronic device of FIG. 1.

Referring to FIG. 2, the main antenna 13 is formed on the outer layer 111. The main antenna 13 is connected to the ground layer 116 by the vias 117. The main antenna 13 may be a planar inverted F-antenna or a loop antenna.

Figure 3:
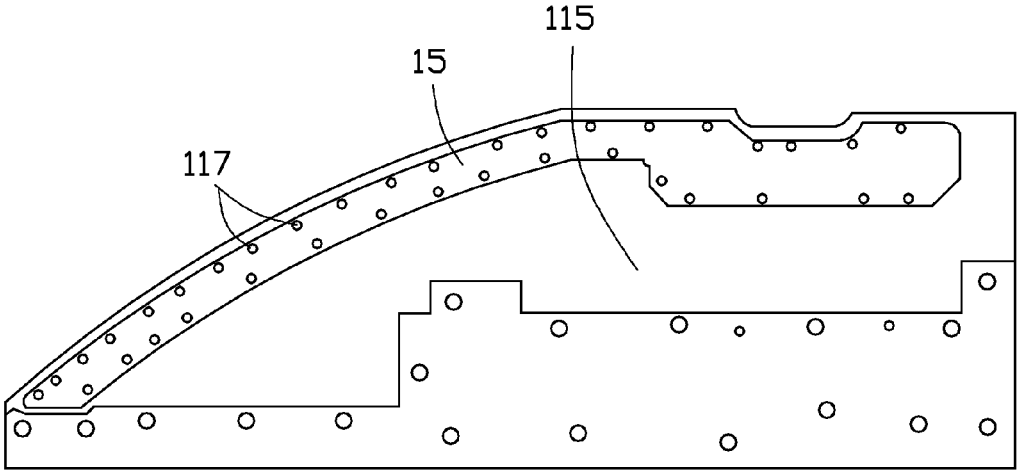
FIG. 3 is a schematic view of one embodiment of a second inner layer of the electronic device of FIG. 1.

Referring to FIG. 3, the minor antenna 15 is formed on the second inner layer 115. The minor antenna 15 is a metal layer, and electrically connected to the main antenna 13 through the vias 117.

The electronic element 17 may be a camera, or a speaker mounted on the outer layer 111. The electronic element 17 is soldered on the main antenna 13. Because the main antenna 13 is connected to the ground layer 116, the electronic element 17 can be connected to the ground layer 16 by the main antenna 13 and grounded.

Referring to table 1, when the electronic element 17 is soldered on the outer layer 111 adjacent to the main antenna 13 and directly connected to the grounded layer 116, antenna gains (RL) and radiation efficiencies of the main antenna 13 at frequencies about 2400 MHz-2500 MHz are as below. Table 1 is an exemplary embodiment of the RL and radiation efficiencies measurement of the main antenna 13 at frequencies about 2400 MHz-2500 MHz, which may depend on factors such as material and dimensions of the main antenna 13 and the minor antenna 15.

TABLE 1

| | Frequency (MHz) | | | | | | | |
|---|---|---|---|---|---|---|---|---|
| | 2400 | 2420 | 2440 | 2450 | 2460 | 2470 | 2480 | 2500 |
| Antenna Gain (dB) | −8.6 | −7.5 | −6.8 | −6.6 | −6.4 | −6.8 | −7.0 | −7.8 |
| Radiation efficiency (%) | 13.8 | 17.8 | 20.7 | 21.9 | 22.8 | 20.9 | 19.9 | 16.6 |

Referring to table 2, when the electronic element 17 is directly soldered on the main antenna 13 and electrically connected to the grounded layer 116 through the main antenna 13, the antenna gains and the radiation efficiencies of the main antenna 13 at the frequencies about 2400 MHz-2500 MHz are as below. Table 2 is an exemplary embodiment of the RL and radiation efficiencies measurement of the main antenna 13 at frequencies about 2400 MHz-2500 MHz, which may depend on factors such as material and dimensions of the main antenna 13 and the minor antenna 15.

TABLE 2

| | Frequency (MHz) | | | | | | | |
|---|---|---|---|---|---|---|---|---|
| | 2400 | 2420 | 2440 | 2450 | 2460 | 2470 | 2480 | 2500 |
| Antenna Gain (dB) | −1.3 | −10. | −1.0 | −0.9 | −0.8 | −1.0 | −1.1 | −1.2 |
| Radiation efficiency (%) | 74.9 | 78.7 | 79.2 | 81.2 | 82.9 | 78.9 | 78.4 | 76.4 |

In comparing table 2 with table 1, at a frequency of about 2460 MHz, the main antenna 13 has maximal radiation efficiency of 82.9% compared to 22.8%, and a maximal antenna gain of −0.08 dB compared to −6.4 dB in table 1. Therefore, the main antenna 13 has an improved radiation performance when the electronic element 17 is electrically connected to the grounded layer 116 through the main antenna 13.

The electronic element 17 is directly soldered on the main antenna 13, which saves space in the electronic device 100. In addition, the electronic element 17 is grounded by the main antenna 13, thus preventing interference to the main antenna 13 by the electronic element 17.

Figure 4:
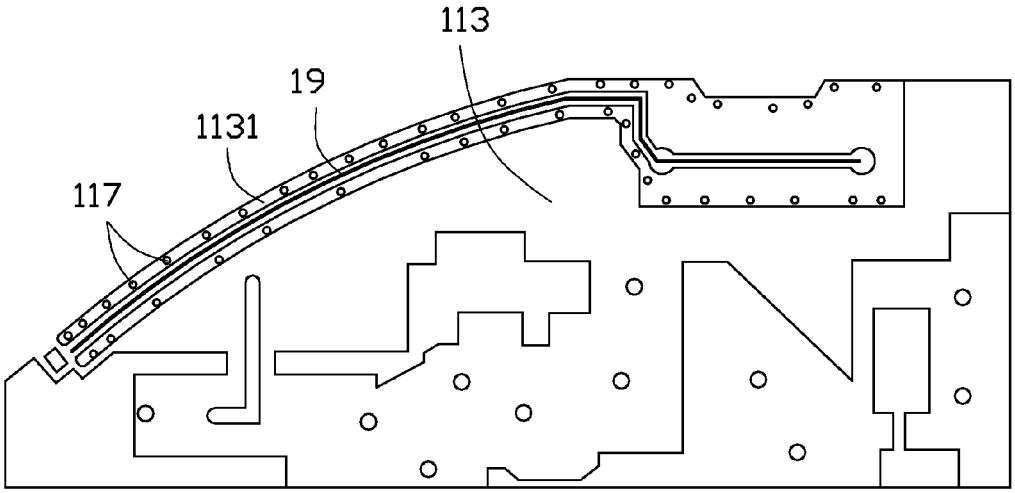
FIG. 4 is a schematic view of one embodiment of a first inner layer of the electronic device of FIG. 1.

In other embodiments, the circuit board 11 further includes a plurality of traces set therein to electrically connect various electronic elements. Referring to FIG. 4, as illuminated, the circuit board 11 includes at least one trace 19 set in the first inner layer 113. The trace 19 is used to electrically connect the electronic element 17 to other electronic elements, such as a CPU. Two insulation strips 1131 are formed at two sides of the trace 19. Thus, the trace 19 is received in a space formed by the outer layer 111 above the first inner layer 113, the minor antenna 15, and the two insulation strips 1131. When noise are generated from the first inner layer 113 or other layers, the noise are transmitted to the main antenna 13 through the minor antenna 15, and then transmitted to ground by the main antenna 13. Thus, the noise cannot be transmitted to the electronic element 17 through the trace 19, and have less interference to the electronic element 17.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An electronic device, comprising:

a multi-layer circuit board, comprising:

an outer layer;

a ground layer; and a plurality of vias defined in the circuit board and electrically connected the outer layer and the ground layer;

a main antenna mounted on the outer layer and electrically connected to the ground layer by the vias; and an electronic element mounted on the outer layer, soldered on the main antenna, and electrically connected to the ground layer by the main antenna.

2. The electronic device of claim 1, further comprising a minor antenna, the circuit board further comprising a first inner layer and second inner layer orderly set between the outer layer and the ground layer, the minor antenna mounted on the second inner layer.

3. The electronic device of claim 2, wherein the minor antenna is electrically connected to the main antenna by the vias.

4. The electronic device of claim 3, wherein the minor antenna is a metal layer.

5. The electronic device of claim 2, wherein the circuit board further includes at least one trace connected to the electronic element and two insulation strips set at two side of the trace.

6. The electronic device of claim 5, wherein the at least one trace is set in the first inner layer.

7. The electronic device of claim 1, wherein the main antenna is a planar inverted F-antenna or a loop antenna.

* * * * *